United States Patent [19]

Stojek et al.

[11] Patent Number: 4,463,712

[45] Date of Patent: Aug. 7, 1984

[54] DEVICE FOR VARYING THE VALVE TIMING OF INTERNAL COMBUSTION ENGINES IN CORRELATION TO LOAD AND SPEED

[75] Inventors: Dieter Stojek, Bergisch-Gladbach; Gerhard Weigmann, Pulheim, both of Fed. Rep. of Germany

[73] Assignee: Ford Motor Company, Dearborn, Mich.

[21] Appl. No.: 442,323

[22] Filed: Nov. 17, 1982

[30] Foreign Application Priority Data

Nov. 25, 1981 [DE] Fed. Rep. of Germany ..... 3146613

[51] Int. Cl.[3] ..... F01L 1/34

[52] U.S. Cl. ..... 123/90.17; 123/90.31

[58] Field of Search ..... 123/90.15, 90.17, 90.31; 464/2

[56] References Cited

U.S. PATENT DOCUMENTS 2,191,459 2/1940 Duncan ..... 123/90.17
3,827,413 8/1974 Meachman ..... 123/90.15
3,978,829 9/1976 Tukahashi et al. ..... 123/90.17
4,305,352 12/1981 Oshima et al. ..... 123/90.15

*Primary Examiner*—William R. Cline
*Assistant Examiner*—Peggy A. Neils
*Attorney, Agent, or Firm*—Robert E. McCollum; Clifford L. Sadler

[57] ABSTRACT

In an apparatus for altering the valve timing of an internal combustion engine as a function of load and rotational speed, a helical pinion is mounted so as to be axially displaceably, but non-rotatably mounted on the camshaft. The pinion is in engagement with an axially fixed helical intermediate gear-wheel driven by the crankshaft. The helical pinion is connected to the camshaft by a splined connection and has tracks for a radial ball bearing, one of which is formed on a sleeve which is guided axially displaceably, but non-rotatably in a part of the camshaft housing by way of a key and keyway connection. The sleeve has a toothed rack portion which is in engagement with an actuating pinion which is driven by an actuating drive controled by a sensor sensing the operating parameters of the engine.

5 Claims, 3 Drawing Figures

DEVICE FOR VARYING THE VALVE TIMING OF INTERNAL COMBUSTION ENGINES IN CORRELATION TO LOAD AND SPEED

The invention relates to an apparatus for altering the value timing of an internal combustion engine as a function of load and rotational speed of the engine.

A first apparatus of this type is known from German Pat. No. 1 094 040, in which the axial movement of a helical pinion, which is secured to the camshaft and which is in engagment with a helical intermediate gear driven by the crankshaft, is used to produce an angular displacement of the camshaft relative to the crankshaft.

Another apparatus of this type is known from the German Offenlegungsschrift No. 2 456 752, in which two camshafts are each provided with an axially displaceable, but non-rotatably mounted helical pinion. Both pinions are in engagement with an axially fixed helical intermediate gear driven by the crankshaft, and the pinions are axially displaceable as a function of the load and rotational speed of the internal combustion engine by way of actuating means. However the actuating means necessary for this purpose is shown and described only in outline and is not explained.

A further apparatus of this type is known from the German Offenlegungsscrift No. 2 909 803 in which an hydrualic annular piston is arranged in a housing disposed at one end of the camshaft. The piston is guided at its inner periphery so as to be axially movable in a straight line along the camshaft, and at its outer periphery acts via a helical connection upon a sprocket wheel which is axially fixed with respect to the camshaft but which is radially rotatable. On account of its mechanical design, this known apparatus is complicated and expensive.

According to the present invention, there is provided an internal combustion engine including means for altering the valve timing as a function of load and rotational speed, the engine having a camshaft for controlling valve movement, a helical pinion mounted on the camshaft by means of a splined connection so as to be axially displaceable, but non-rotatable thereon, the pinion being in engagement with an axially fixed helical intermediate gearwheel driven by the engine crankshaft, a control member connected between the pinion and the camshaft housing, the member being axially displaceable but non-rotatable relative to the housing and being axially fixed relative to the pinion but permitting rotation of the pinion relative to the sleeve, the member having a toothed rack portion which is in engagement with an actuating pinion, and an actuating drive arranged to drive the actuating pinion to axially displace the control member and, with it, the helical pinion, to alter the valve timing, and a control unit which senses load and rotational speed of the engine and controls the actuating drive.

The control member is preferably a sleeve surrounding the camshaft. The connection between the sleeve and the helical pinion may be through a radial ball bearing of which the inner ball track is formed on the sleeve and the outer ball track on an internal surface of the pinion.

There may be two camshafts, each with a pinion on it, with the two pinions both being in engagement with the same intermediate gearwheel.

The actuating drive may be electromechanical or hydraulic, as preferred for a particular application.

The invention will now be further described, by way of example, with reference to the accompanying drawings, in which.

Figure 1:
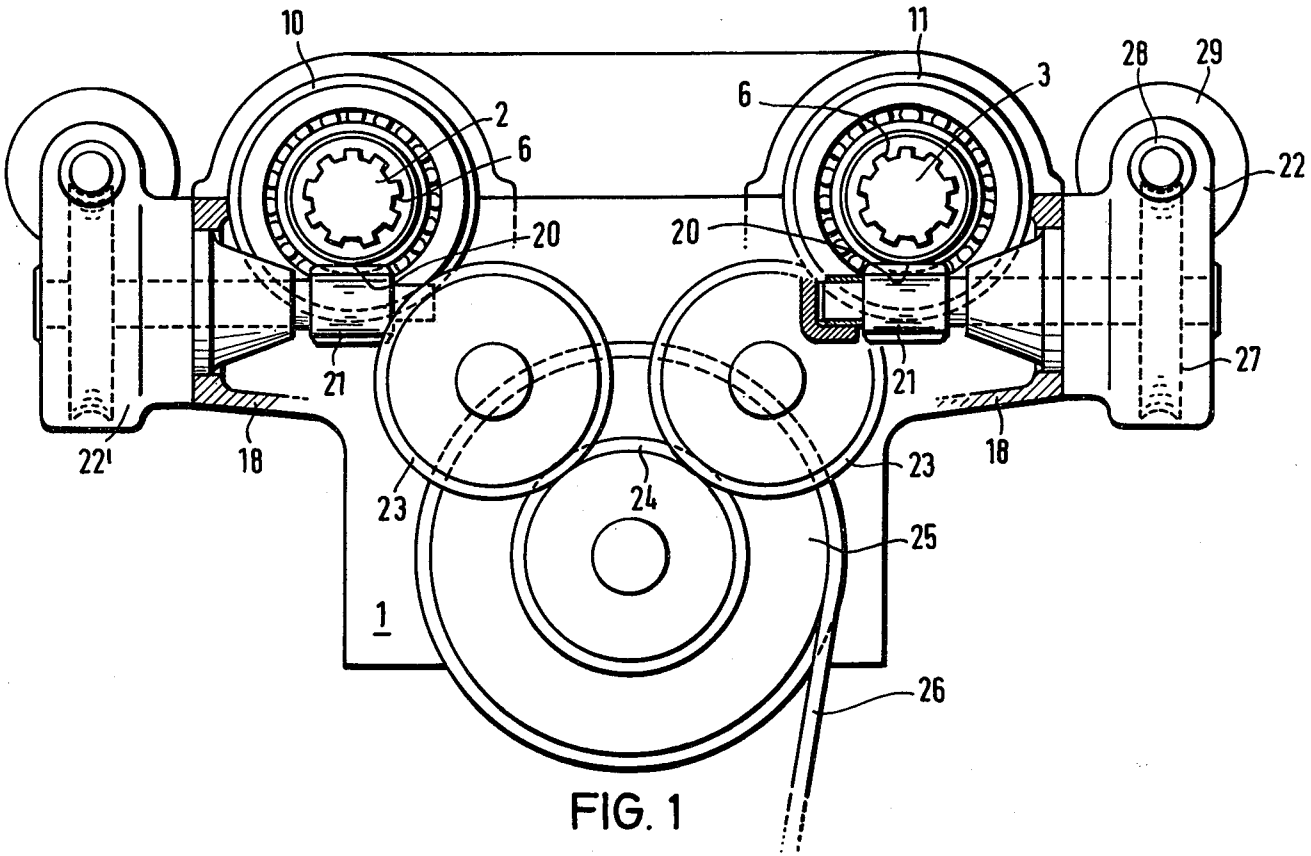
FIG. 1 is a front elevation of part of an engine according to the invention, showing the means for altering the valve timing as a function of load and rotational speed.
Figure 2:
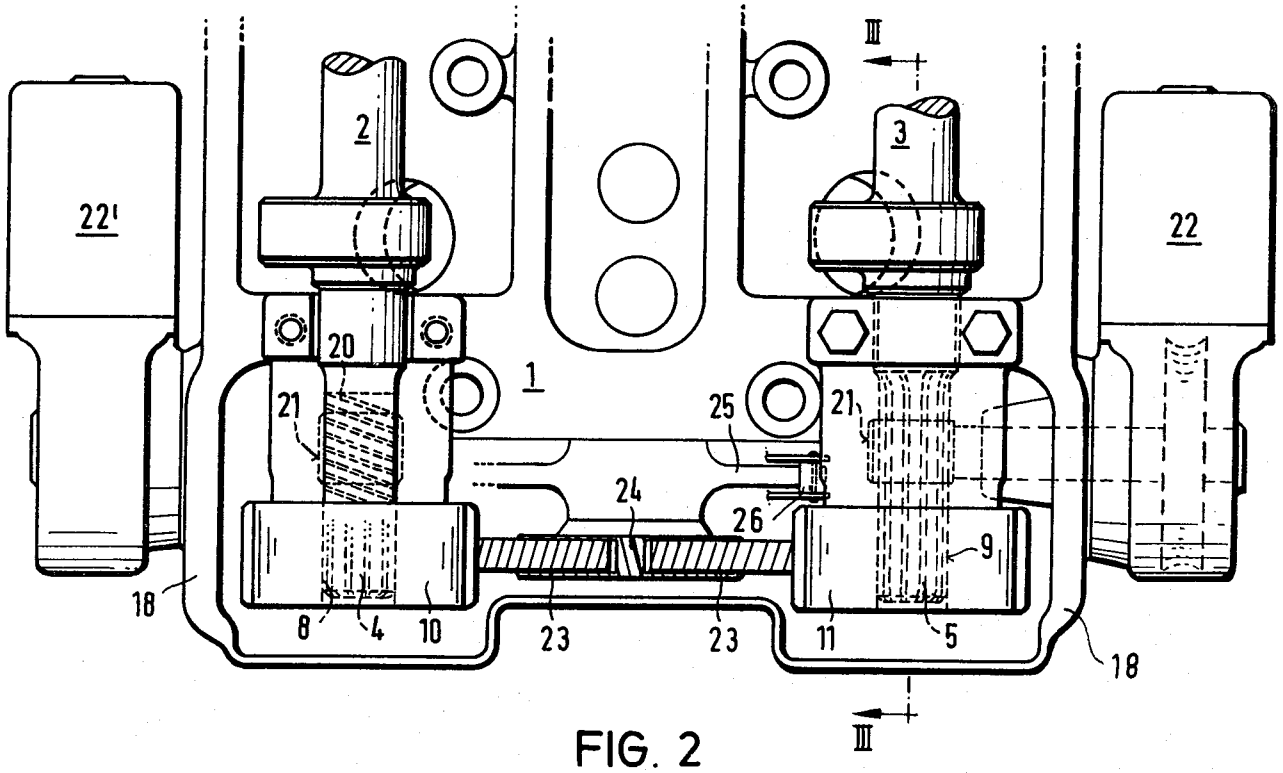
FIG. 2 is a top view of the engine part shown in FIG. 1.

The valve timing of an internal combustion engine is altered as a function of load and rotational speed by means disposed on the cylinder head 1 of the engine. Two camshafts 2 and 3 are mounted in the cylinder head 1 so as to be rotatable and are axially fixed in conventional manner. One end 4,5 of each camshaft 2,3 is provided with splines 6. Two helical pinions 10,11 have bores 8,9—provided with corresponding splines 7—and are mounted on the shafts 2,3 so that the pinions can slide on the shafts.

Figure 3:
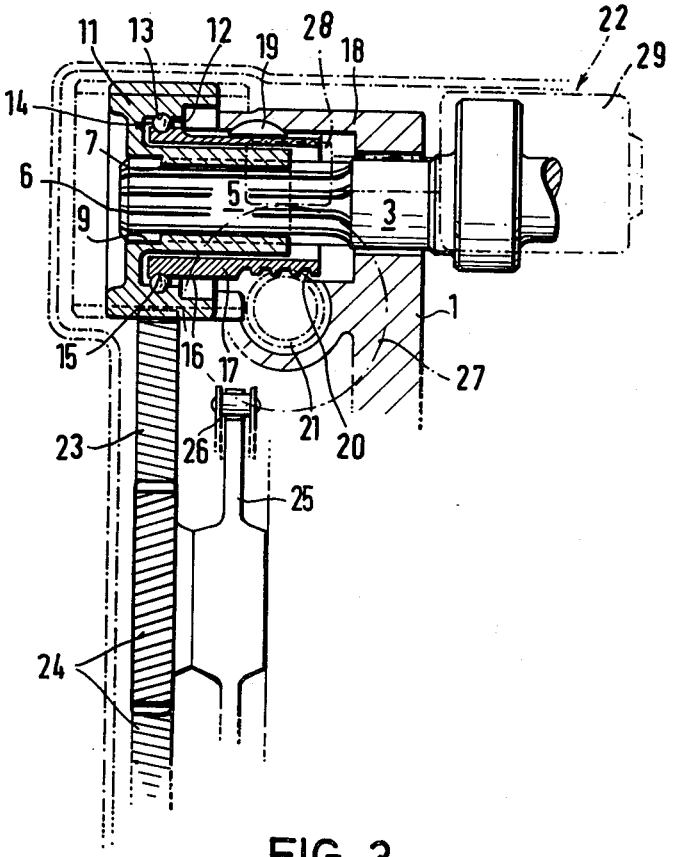
FIG. 3 is a section along the line III—III in FIG. 2 with the position of an electromechanical actuating drive indicated in chain-dotted lines.

As is evident in particular from FIG. 3, a track 13 for a radial ball bearing 14 is formed on the inner periphery 12 of each of the pinions 10 and 11, and the other track 15 of this ball bearing 14 is formed on the outer periphery 16 of a control sleeve 17. The sleeve 17 is guided axially displaceably but non-rotatably in a part 18 of the cylinder head 1 by way of a key and keyway connection 19 and is provided in one area with a toothed rack portion. An actuating pinion 21, which is mounted in part 18 of the cylinder head 1 and is operatively connected to an actuating drive 22 in the form of an electric motor, engages with the said toothed rack portion 20.

The helical pinions 10 and 11 engage with axially fixed gearwheels 23, which are driven by a gearwheel 24 which in turn is driven by the crankshaft of the internal combustion engine by way of a sprocket wheel 25 and a chain 26.

The electromechanical actuating drive 22 includes a wormwheel 27, which is mounted non-rotatably on the shaft of the actuating pinion 21 and engages with a worm 28 which may be driven by an electric motor 29.

The electric motor 29 may be controlled in a known manner by an electronic control unit which emits control pulses of specific direction and duration as a function of the load and rotational speed of the internal combustion engine and other operational parameters. Accordingly, the electric motor 29 will turn the worm 28 by a specific amount to the right or to the left, as a result of which the wormwheel 27 will be rotated. Rotation of the wormwheel 27 therefore produces axial displacement of the sleeve 17 by way of the actuating pinion 21 connected thereto and, by way of the radial ball bearing 14, axial displacement of the corresponding helical pinion 10 or 11.

The helical pinions 10 and 11 associated with the two camshafts 2 and 3 are, of course, separately controllable in each case by their own actuating drive 22 or 22' in order to produce any desired change in the overlapping of the valve timing between the intake and exhaust valves of the internal combustion engine.

Instead of the electromechanical actuating drive described, other forms of actuating drives such as electromagnetic, pneumatic and hydraulic actuating drives may also of course, be used, provided they can be precisely controlled in the required manner.

The apparatus shown is thus able to provide mechanically simple and reliably controllable actuating means for the axial displacement of the helical pinions on the camshafts.

We claim:

1. An internal combustion engine including means for altering the valve timing as a function of load and rotational speed, the engine having a camshaft for controlling valve movement, a helical pinion mounted on the camshaft and having a straight splined connection thereto to be axially displaceable, but non-rotatable relative thereto, the helical pinion being in engagement with an axially fixed helical intermediate gearwheel driven by the engine crankshaft such that axial displacement of the pinion relative to the intermediate gearwheel produces relative rotation of the pinion and the camshaft, a control member between the pinion and the camshaft housing, the control member being axially displaceably but non-rotatably mounted relative to the housing and axially fixed relative to the pinion while permitting rotation of the pinion relative to the control member, the control member having an axially displaceable toothed rack portion, and an actuating drive arranged to axially move the toothed portion to axially displace the control member and the helical pinion to alter the valve timing and means sensitive to load and rotational speed changes of the engine for controlling movement of the toothed portion.

2. An engine as claimed in claim 1, characterized in that the control member is a sleeve surrounding the camshaft.

3. An engine as claimed in claim 2, including a radial ball bearing between the sleeve and the helical pinion having an inner ball track formed on the sleeve and an outer ball track on an internal surface of the pinion.

4. An engine as claimed in claim 1, characterized in that the actuating drive is electromechanical.

5. An engine as claimed in claim 1, characterized in that the actuating drive is hydraulic.

* * * * *